US011641951B2

(12) United States Patent
Kowalski et al.

(10) Patent No.: US 11,641,951 B2
(45) Date of Patent: May 9, 2023

(54) TEMPERATURE-CONTROLLED CRADLE

(71) Applicant: Comfort Innovations LLC, Lakeland, FL (US)

(72) Inventors: Wendy Kowalski, Lakeland, FL (US); Charles Khalil, Doral, FL (US)

(73) Assignee: Comfort Innovations LLC, Lakeland, FL (US)

( * ) Notice: Subject to any disclaimer, the term of this patent is extended or adjusted under 35 U.S.C. 154(b) by 173 days.

(21) Appl. No.: 17/123,769

(22) Filed: Dec. 16, 2020

(65) Prior Publication Data

US 2022/0183477 A1 Jun. 16, 2022

(51) Int. Cl.

| | |
|---|---|
| ***A47D 9/00*** | (2006.01) |
| ***F25B 21/02*** | (2006.01) |
| ***A61G 17/00*** | (2006.01) |
| ***F25D 11/00*** | (2006.01) |

(52) U.S. Cl.

CPC ..... *A47D 9/00* (2013.01); *A61G 17/002* (2013.01); *F25B 21/02* (2013.01); *F25D 11/003* (2013.01)

(58) Field of Classification Search

CPC ..... A47D 9/00; A61G 17/002; F25B 21/02
See application file for complete search history.

(56) References Cited

U.S. PATENT DOCUMENTS

| | | | | |
|---|---|---|---|---|
| 5,713,208 | A * | 2/1998 | Chen | F25B 21/02 62/434 |
| 6,625,852 | B1 | 9/2003 | Hanson | |
| 10,684,056 | B2 | 6/2020 | Kowalski | |
| 2009/0112368 | A1 | 4/2009 | Mann, III et al. | |
| 2015/0059360 | A1* | 3/2015 | Lin | F25B 21/02 165/104.31 |
| 2016/0051403 | A1 | 2/2016 | Thomas et al. | |
| 2018/0110266 | A1* | 4/2018 | Lee | H01L 27/16 |
| 2019/0041116 | A1* | 2/2019 | Kowalski | F25D 11/003 |

FOREIGN PATENT DOCUMENTS

| | | | | |
|---|---|---|---|---|
| CN | 205180922 | U | 4/2016 | |
| GB | 1501281 | A | 2/1978 | |
| GB | 2429400 | A * | 2/2007 | A47C 21/044 |
| JP | S48102000 | U | 11/1973 | |
| JP | 2004261199 | A * | 9/2004 | A61G 17/002 |
| JP | 2009011574 | A * | 1/2009 | A01N 1/00 |

(Continued)

OTHER PUBLICATIONS

JP-2009011574-A translation.*

(Continued)

*Primary Examiner* — Elizabeth J Martin
(74) *Attorney, Agent, or Firm* — Burr & Forman LLP; Ryan M. Corbett

(57) ABSTRACT

A temperature-controlled cradle and method of cooling same are provided. The temperature-controlled cradle may include a base having an outer housing and a cooling unit disposed within the outer housing, and a bassinet coupled to the base. The cooling unit may include a cooling plate having a first side configured to chill an interior portion of the bassinet, at least one thermoelectric cooling module coupled to a second side of the cooling plate, and a heat dissipation device configured to dissipate heat from the at least one thermoelectric cooling module.

19 Claims, 7 Drawing Sheets

(56) References Cited

FOREIGN PATENT DOCUMENTS

| | | |
|---|---|---|
| JP | 2013034709 A | 2/2013 |
| WO | 2018204396 A1 | 5/2017 |

OTHER PUBLICATIONS

JP-2004261199-A translation.*
International Search Report and Written Opinion of International Searching Authority of International Application No. PCT/US2018/030503, dated Aug. 17, 2018.
Flexmort, CuddleCot system, webpage captured from flexmort.com/cuddle-cots/ on Dec. 14, 2020.
Flexmort, CuddleCot flyer, obtained from https://flexmort.com/wp-content/uploads/2012/12/CuddleCot-Flyer-2017.pdf on Dec. 14, 2020.

* cited by examiner

TEMPERATURE-CONTROLLED CRADLE

TECHNICAL FIELD

The present disclosure relates generally to a temperature-controlled baby cradle or bassinet, and more specifically to a temperature-controlled baby cradle or bassinet that maintains a low temperature for extended preservation of a baby or infant who has died.

BACKGROUND

The loss of a baby, or infant, can be devastating for the parents. The death of a baby can be classified in two main areas—a pregnancy loss or an infant death. A "pregnancy loss" may be defined as a stillbirth, which is the birth of a baby, or infant, who has died in the womb any time after 20 weeks gestation (considered the age of fetal viability). The causes of death can range from, but are not limited to, genetic disorders, maternal disorders, placenta problems, cord knots or compressions, injury to the mother, injury to the baby, illnesses, and in some cases there are no known causes. "Infant death" refers to any baby who survived birth up through one year of age and then passes for any reason. Causes include, but are not limited to, congenital abnormality, prematurity, injury, illness, SIDS, accident, or other various causes.

Stillbirth is one of the most devastating of losses, affecting over 25,000 families each year. Stillbirth affects families of all races, religions, and socio-economic status. For many parents, stillbirth is a loss that hit unexpectedly—up to half of all stillbirths occur in pregnancies that had seemed problem-free.

Parents in these circumstances often desire an extended period of time to grieve the loss of their child in a comfortable, unhurried setting. However, past methods of addressing the matter have fallen short. Often the deceased baby is quickly removed to a morgue or stored in a cooler, or refrigeration device, in the hospital, such as a neonatal care unit. This interrupts the grieving process and lacks sensitivity. Using ice packs, dry ice, or chilled rice bags are a short-term solution, requiring restocking or re-chilling and sometimes the use of harmful chemicals, and result in significant temperature fluctuations and wetness due to melting. Similarly, turning the temperature down in the entire room is a short-term solution that leads to temperature fluctuations and can make the entire room uncomfortable. Accordingly, there is a need for a cradle that can preserve the deceased baby in a way that allows the family to grieve in a comfortable manner.

SUMMARY

According to an aspect of one or more embodiments, there is provided a temperature-controlled cradle that may include a base having an outer housing and a cooling unit disposed within the outer housing, and a bassinet coupled to the base. The cooling unit may include a cooling plate having a first side configured to chill an interior portion of the bassinet, at least one thermoelectric cooling module coupled to a second side of the cooling plate, and a heat dissipation device configured to dissipate heat from the at least one thermoelectric cooling module.

The heat dissipation device may include a heat sink, and the at least one thermoelectric cooling module may be disposed between the second side of the cooling plate and the heat sink. The cooling unit may also include a blower fan configured to blow air toward or away from the heat sink.

The cooling unit may also include a duct coupled to the blower fan and the heat sink, and configured to direct the air blown by the blower fan toward or away from the heat sink. The duct may include at least one open end portion that is configured to allow air to escape from or enter the duct. The duct may also include two lateral sides, at least one of which may include at least one flap that is configured to open to allow air to escape from or enter the duct.

The temperature-controlled cradle may also include a divider plate slidably disposed between the duct and the blower fan to control air flow from the blower fan to the duct. The temperature-controlled cradle may also include a foam or otherwise insulating layer coupled to the second side of the cooling plate. The foam layer may include at least one cutout portion through which the at least one thermoelectric cooling module is disposed in contact with the second side of the cooling plate.

According to an exemplary embodiment, the heat dissipation device may include a cooling block configured to contain a cooling liquid, and disposed in contact with said at least one thermoelectric cooling module, a radiator configured to receive the cooling liquid from the cooling block, a pump configured to pump the cooling liquid from the cooling block to the radiator, and a fan configured to blow air toward or away from the radiator. The at least one thermoelectric cooling module may be disposed between the second side of the cooling plate and the cooling block. According to an exemplary embodiment, a bottom portion of the bassinet may be open, and the cooling plate may be co-planar with the bottom portion of the bassinet.

According an aspect of one or more exemplary embodiments, there is provided a method of cooling a temperature-controlled cradle that includes the steps of applying a DC voltage to at least one thermoelectric cooling module having a first side coupled to a cooling plate disposed within a bassinet of the temperature-controlled cradle, transferring heat from the first side of the at least one thermoelectric cooling module to a second side of the at least one thermoelectric cooling module, and dissipating heat from the second side of the at least one thermoelectric cooling module. Dissipating heat from the second side of the at least one thermoelectric cooling module may include using a heat sink disposed against the second side of the at least one thermoelectric cooling module to dissipate heat therefrom.

Dissipating heat from the second side of the at least one thermoelectric cooling module may also include blowing air toward or away from the heat sink, and optionally blowing air through a duct toward the heat sink or from the heat sink though the duct. The duct may include at least one open end portion configured to allow the air to escape from the duct. The duct may also include two lateral sides, at least one of which may include at least one flap that is configured to open to allow air to escape from or be sucked into the duct. The method may also include insulating a side of the cooling plate to which the at least one thermoelectric cooling module is coupled using a foam or other insulating material layer. According to an exemplary embodiment, the method may also include using a cooling block configured to contain a cooling liquid for absorbing heat from the second side of the at least one thermoelectric cooling module, pumping the cooling liquid from the cooling block to a radiator configured to absorb heat from the cooling liquid, and blowing air toward or away from the radiator to dissipate heat from the radiator.

DETAILED DESCRIPTION OF EXEMPLARY EMBODIMENTS

Figure 1:
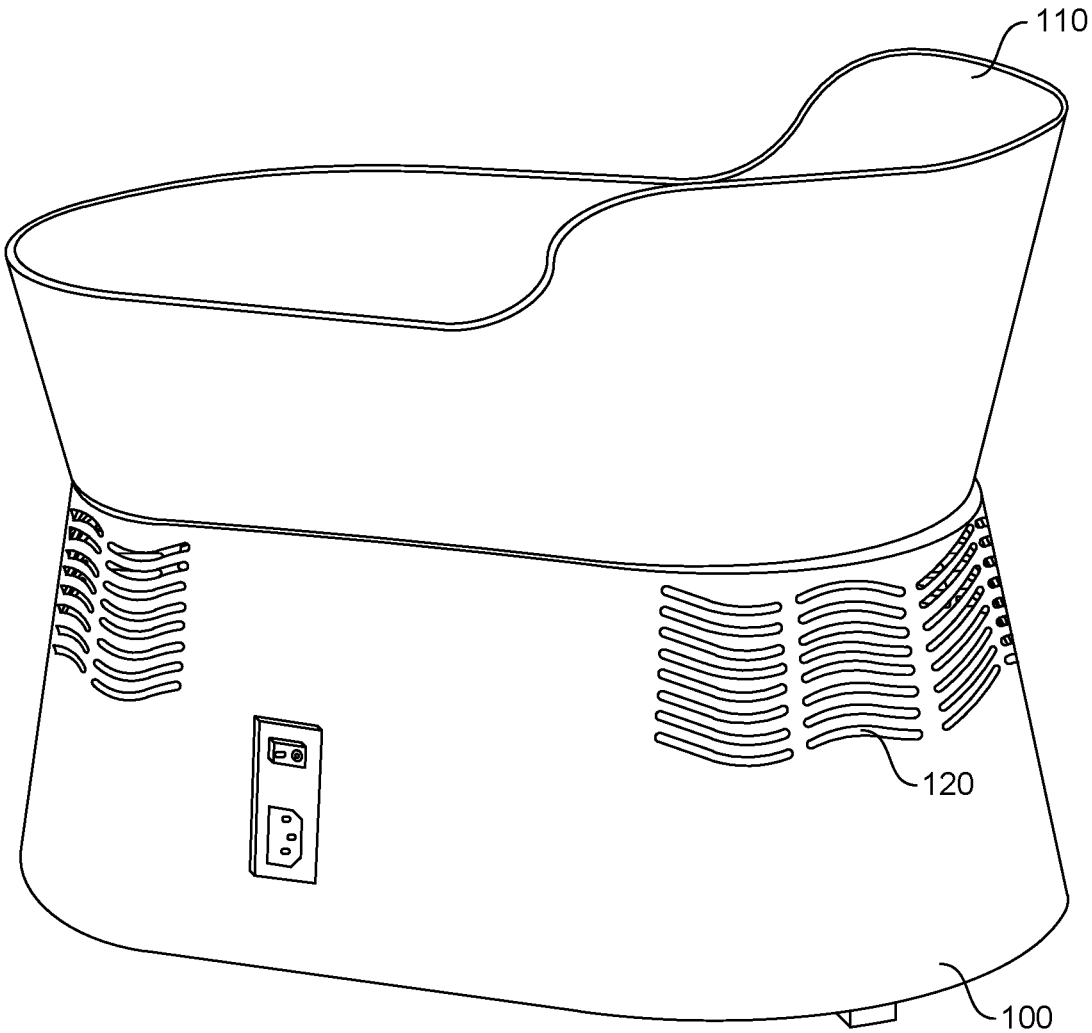
FIG. 1 shows a lateral view of a temperature-controlled cradle according to an exemplary embodiment.

Reference will now be made in detail to the following exemplary embodiments, which are illustrated in the accompanying drawings, wherein like reference numerals refer to like elements throughout. The exemplary embodiments may be embodied in various forms without being limited to the exemplary embodiments set forth herein. Descriptions of well-known parts are omitted for clarity.

FIG. 1 shows a temperature-controlled cradle according to an exemplary embodiment. Referring to FIG. 1, the exemplary temperature-controlled cradle may include a base 100 and a bassinet that is coupled to the base. The base 100 shown in the exemplary embodiment of FIG. 1 may be substantially oval-shaped, however the base may be any other shape. The exemplary bassinet 110 of FIG. 1 may also be oval-shaped, but like the base 100, may take any other shape. The bassinet may be sized and shaped to accommodate one or more infants or babies. The bassinet 110 may have side walls that extend upward from the base 100 to secure the one or more infants or babies within the bassinet 110. The base 100 may also include one or more ventilation slots 120 that are configured to allow air to pass through the base 100, as will be described in more detail below.

Figure 2:
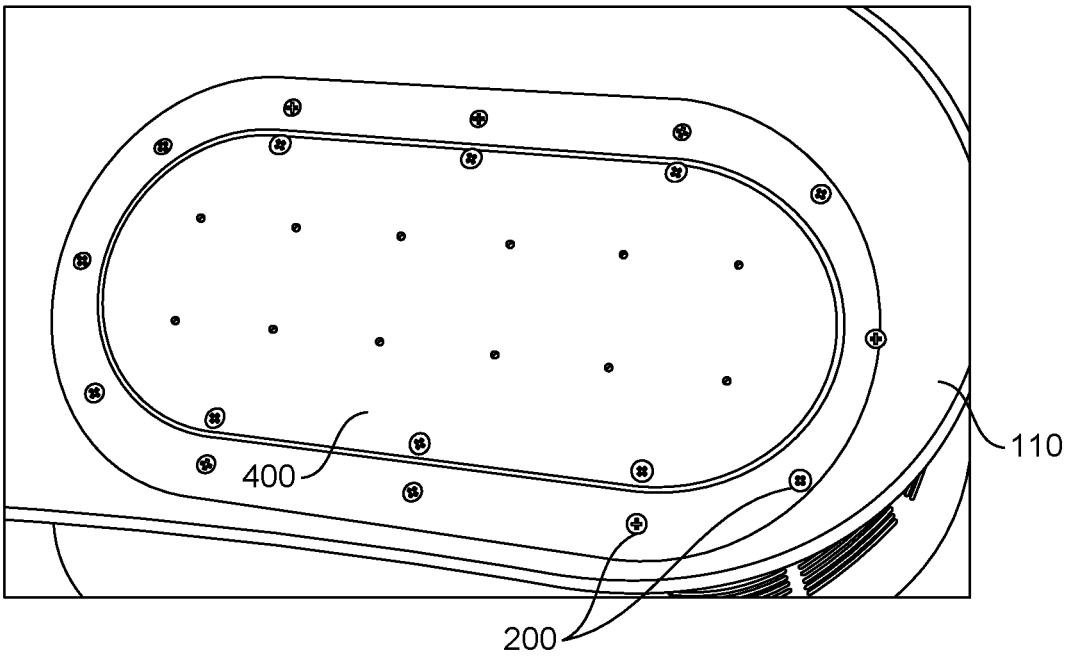
FIG. 2 shows a top view of a temperature-controlled cradle according to an exemplary embodiment.
Figure 3:
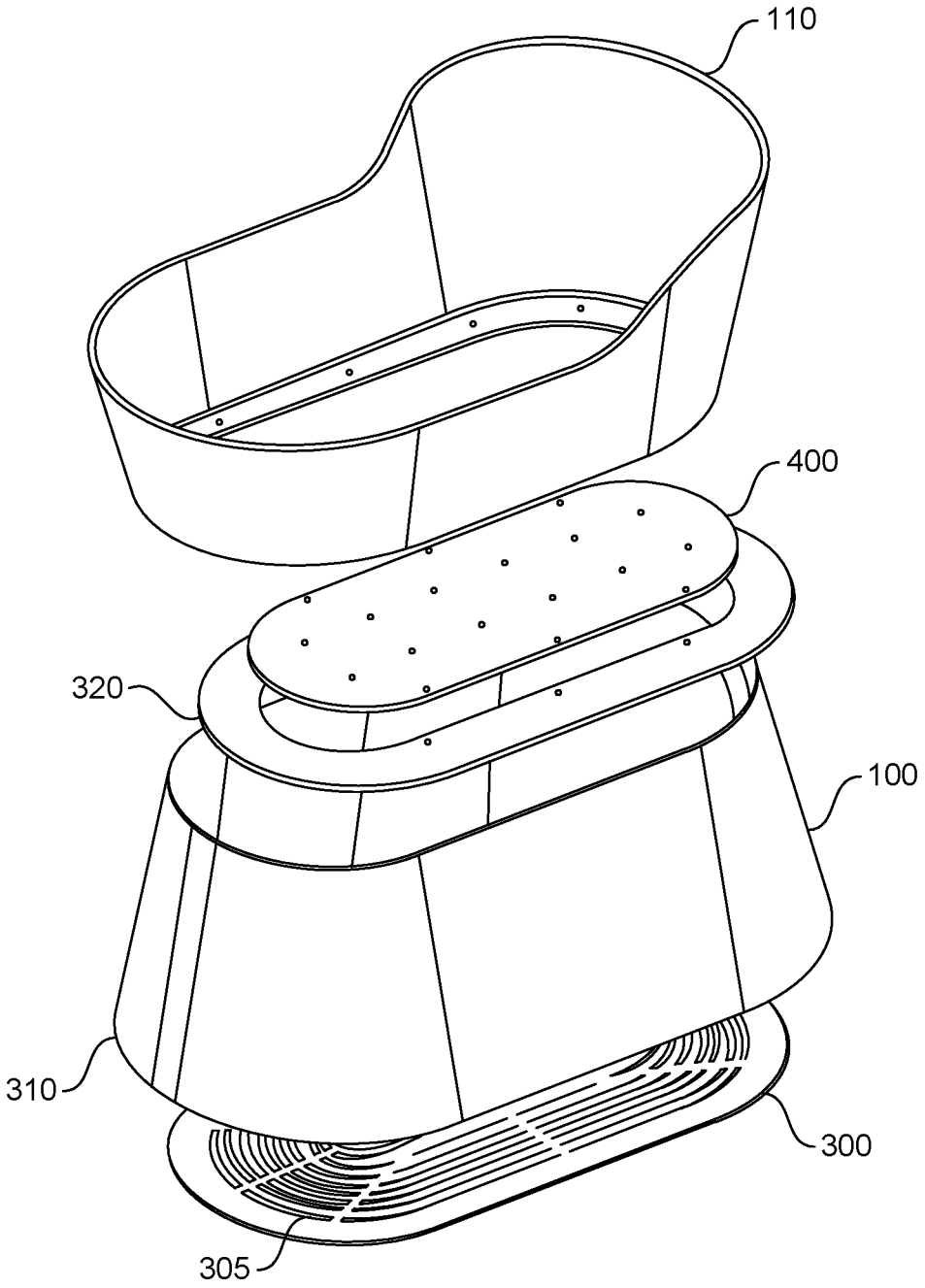
FIG. 3 shows an exploded view of a temperature-controlled cradle according to an exemplary embodiment.

FIGS. 2 and 3 show top and exploded views, respectively, of a temperature-controlled cradle according to an exemplary embodiment. Referring to FIGS. 2 and 3, the base 100 of the exemplary temperature-controlled cradle may include a bottom plate 300 and a hollow outer housing 310 that is configured to be coupled to the bottom plate 300. The base 100 may also include a ring-shaped flange portion 320 that is coupled to the outer housing 310. The flange portion 320 may include a flat rim portion to which the bassinet 110 may be coupled using a plurality of fasteners 200. The fasteners 200 may be any type of coupling device such as screws, nails, adhesives, etc. The bottom plate 300 include one or more ventilation slots 305 to allow air to pass through the base 100. Also shown in FIGS. 2 and 3 is a cooling plate 400 that is configured to chill an interior portion of the bassinet 110, as will be explained in more detail below. According to the exemplary embodiment of FIGS. 2 and 3, the cooling plate 400 may be disposed within a hollow center of the flange portion 320, such that the cooling plate 400 substantially forms the bottom of the bassinet 110, which may be open on the bottom. Alternatively, the bassinet 110 may include a thermally-conductive bottom portion (not shown) that is disposed directly on top of the cooling plate 400 so that the chilling effect of the cooling plate 400 is transferred to the thermally-conductive bottom portion to chill an interior portion of the bassinet 110.

Figure 4:
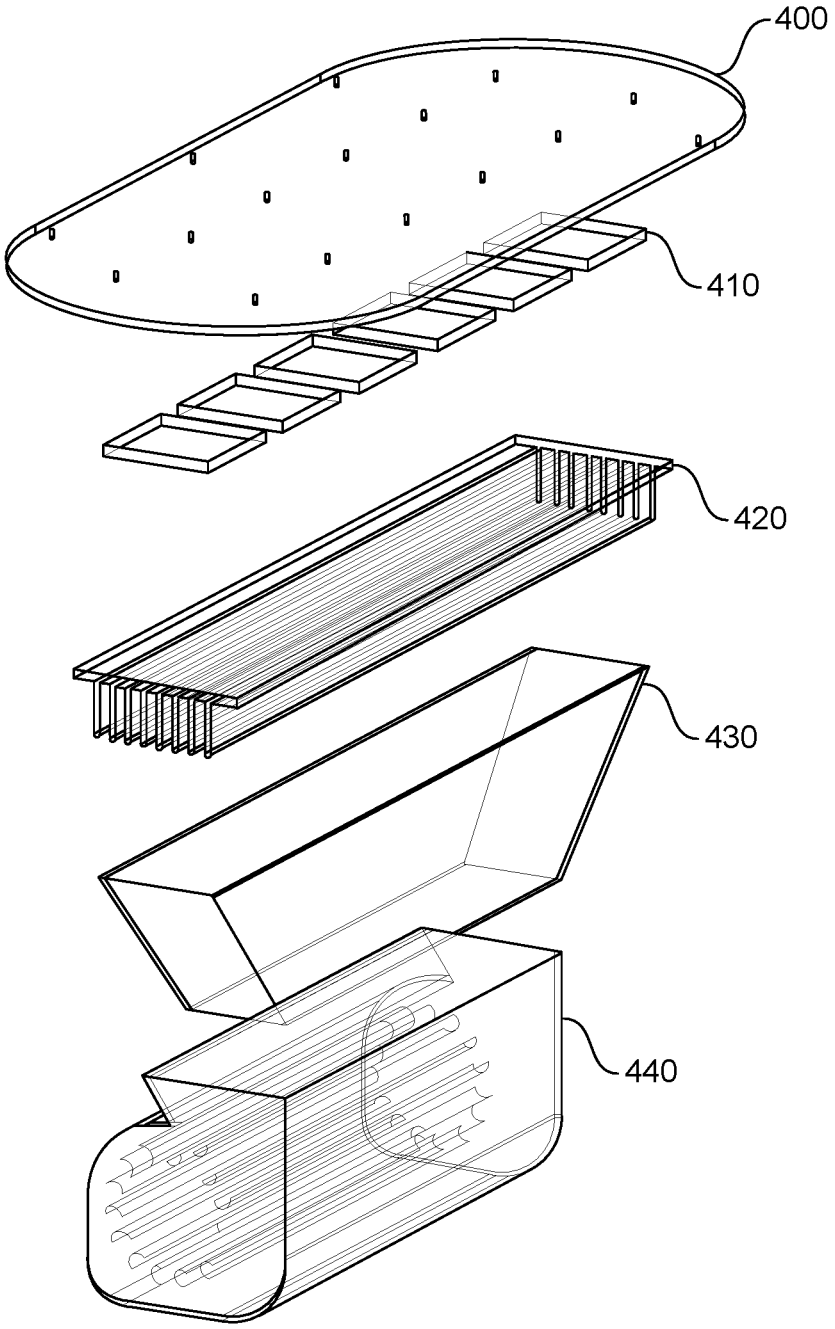
FIG. 4 shows an exploded view of a cooling unit according to an exemplary embodiment.
Figure 5:
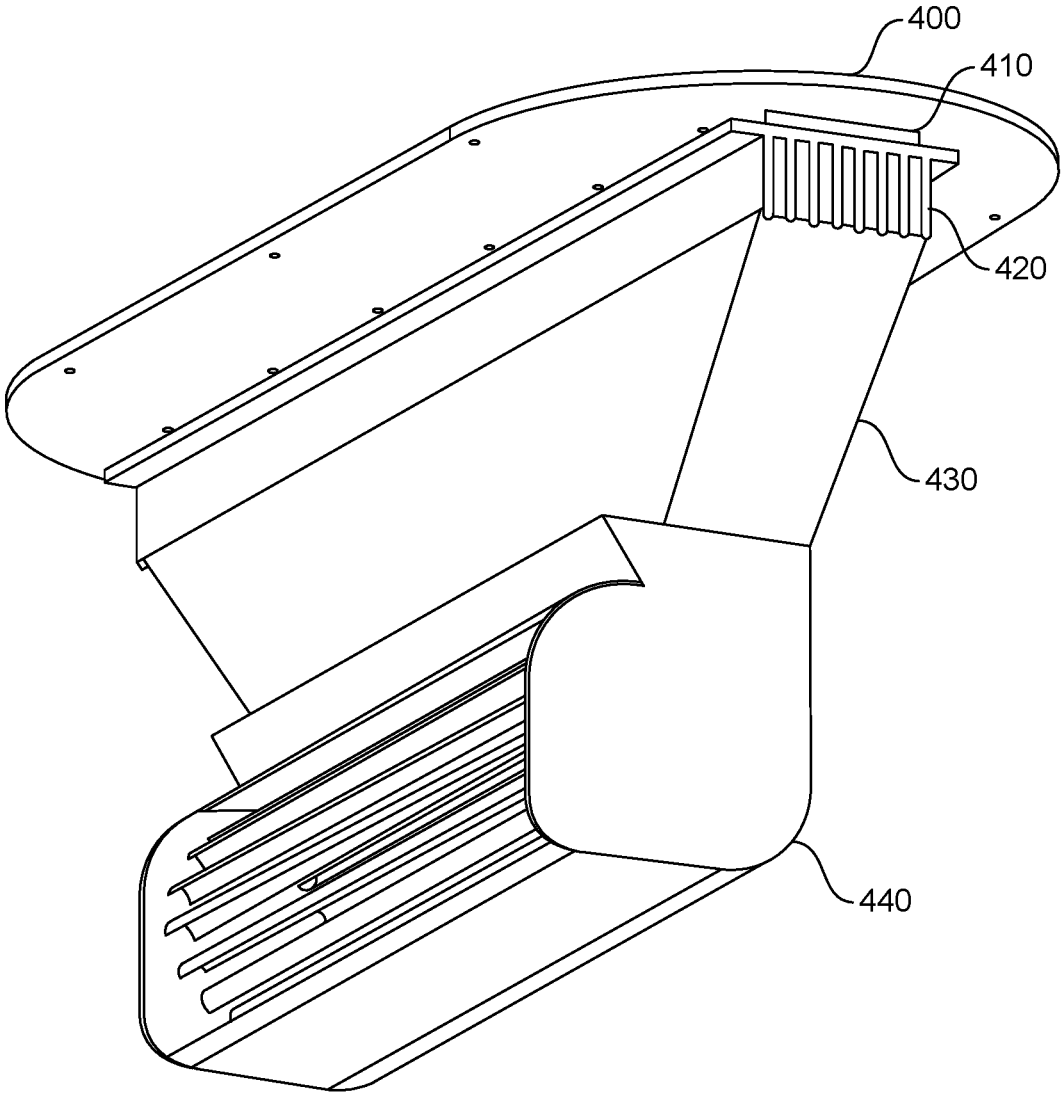
FIG. 5 shows a perspective view of a cooling unit according to an exemplary embodiment.

FIGS. 4 and 5 show exploded and perspective views, respectively, of a cooling unit according to an exemplary embodiment, which is configured to cool the interior of the bassinet 110. The cooling unit may include a cooling plate 400 and a plurality of thermoelectric cooling modules 410 that are disposed directly beneath and in contact with the cooling plate 400. Each of the thermoelectric cooling modules 410 may include alternating n-type and p-type semiconductors that are located thermally in parallel to each other and electrically in series. The semiconductors may be located between two thermally conducting plates (one hot plate and one cold plate), and two free ends of the semiconductors may be coupled to a DC voltage supply or battery. When the semiconductors are coupled to the DC voltage supply, a DC current flows across the junction of the semiconductors, which causes a heat gradient that results in a heat transfer from the cooling plate to the heating plate. The cold plate of each thermoelectric cooling module 410 is located adjacent to and in contact with the cooling plate 400 such that as heat is transferred from the cold plate to the hot plate, the cold plate becomes cold, which in turn cools the cooling plate 400. According to the exemplary embodiment of FIG. 4, the thermoelectric cooling modules 410 may be connected in series, and may be arranged linearly under the cooling plate 400. However, the thermoelectric cooling modules 410 may be used in pairs or clusters and may be wired in series or parallel configurations. According to an exemplary embodiment, the thermoelectric cooling modules may be rated for a particular DC supply voltage. However, supplying a lower voltage, such as half or ⅔ of the rated voltage may reduce the chances of overheating the thermoelectric cooling modules 410, as well as extending the service life of the thermoelectric cooling modules 410.

As heat is transferred from the cold plate to the hot plate of each thermoelectric cooling module 410, the heat may be dissipated by a heat dissipation device or system. In the exemplary embodiment of FIG. 4, the heat dissipation device is a heat sink 420, which may include a flat portion that is disposed against the hot plates of the thermoelectric cooling modules 410, and multiple parallel plates that are disposed perpendicularly to the flat portion. The heat sink 420 absorbs heat from the hot plates of the thermoelectric cooling modules 410 so that the heat does not increase the temperature of the cooling plate 400. The heat sink 420 may be coupled to the cooling plate 400 via any type of connector such as screws, nails, adhesive, etc. such that the thermoelectric cooling modules 410 are pressed into contact with the cooling plate 400 and the heat sink 420.

Figure 6:
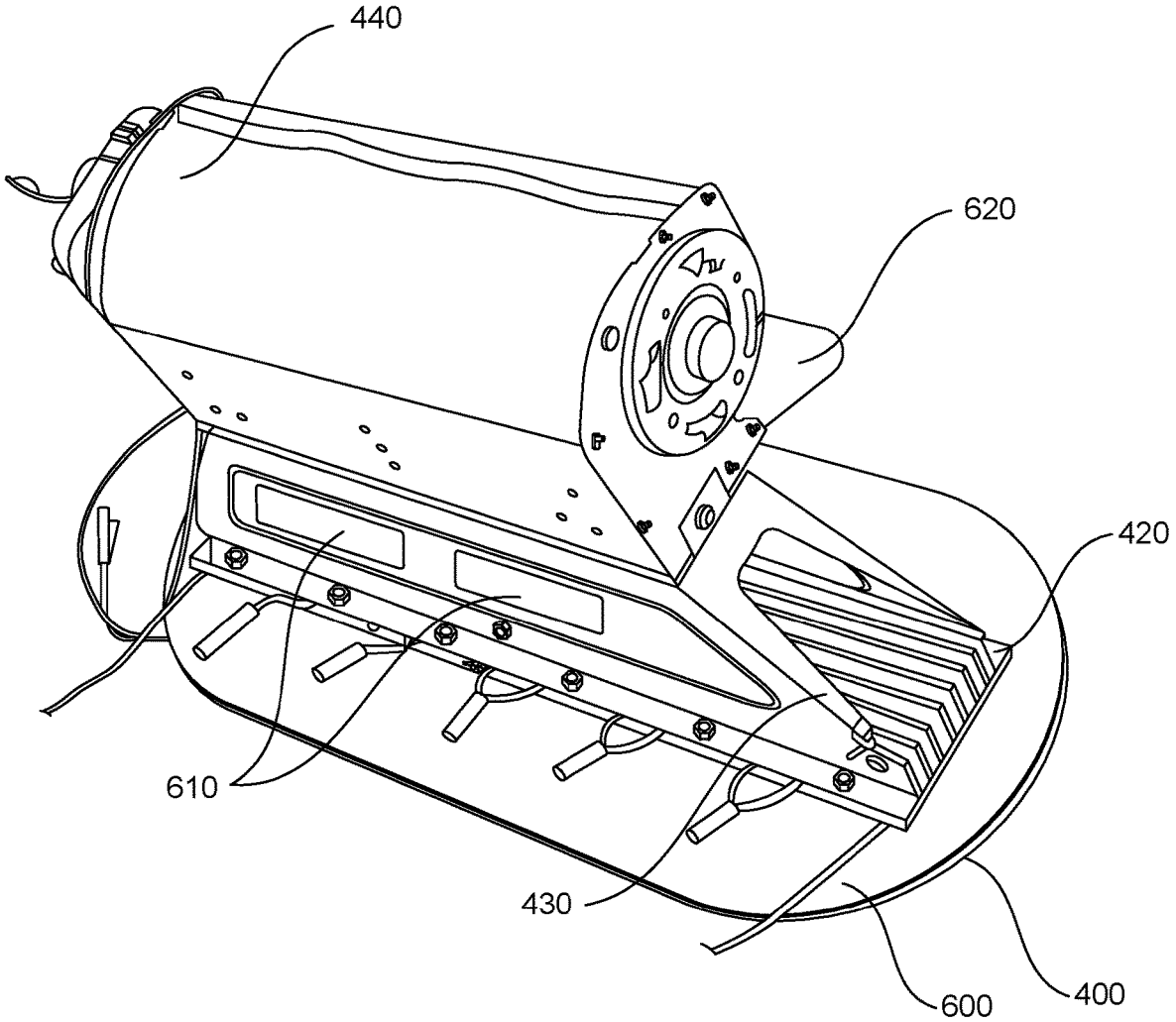
FIG. 6 shows an inverted view of a cooling unit according to an exemplary embodiment.

The exemplary cooling unit of FIGS. 4 and 5 may also include a duct 430 and a blower fan 440. The duct 430 may be substantially hollow, and configured to allow air from the blower fan 440 to contact the heat sink 420 to dissipate heat transferred from the thermoelectric cooling modules 410. As shown in FIG. 6, duct 430 may have end portions that are open to allow air to pass through the duct 430, and out of the base 100 through ventilation slots 120. Although the duct 430 shown in FIGS. 4 and 5 is substantially trapezoidal in shape, the duct 430 may take any shape.

FIG. 6 shows a cooling unit according to an exemplary embodiment. The cooling unit shown in FIG. 6 is similar to the cooling unit shown in FIGS. 4 and 5, in that it includes a cooling plate 400, heat sink 420, a plurality of thermoelectric cooling modules (not visible, except for lead wires extending from underneath heat sink 420), duct 430, and blower fan 440. The exemplary cooling unit of FIG. 6 also includes a layer of insulating foam 600 located between the cooling plate 400 and the heat sink 420. The insulating foam 600 may have cutouts sized and shaped according to the thermoelectric cooling modules 410 so that the thermoelectric cooling modules 410 make direct contact with the cooling 400. For example, the insulating foam 600 may have a series of square cutouts arranged linearly, or in any other arrangement, to accommodate the plurality of thermoelectric cooling modules 410. The insulating foam 600 may insulate the cooling plate 400 from heat absorbed and dissipated by the heat sink 420 so that the heat does not increase temperature of the cooling plate 400.

The cooling unit of FIG. 6 may also include a duct 430 that has open ends to allow air to flow through. The duct 430 may also include one or more flaps 610 located on one or both lateral sides of duct 430 that can be opened or closed to allow more or less air to flow through the duct 430. According to an alternative exemplary embodiment, instead of flaps 610, the duct 430 may have one or more holes or orifices in one or both lateral sides to allow air to exit the duct 430. The size of the holes or orifices may adjustable, for example, by adjusting a plate to partially cover some or all of the holes. The exemplary cooling unit of FIG. 6 may also include a divider plate 620 that is slidably disposed perpendicularly to the flow of air from the blower fan 440 to the duct 430. The divider plate 620 may be configured to slide laterally to control the flow of air from the blower fan 440 to the duct 430. By controlling the amount of air flowing from the blower fan 440, surging of the cooling unit may be avoided.

Figure 7:
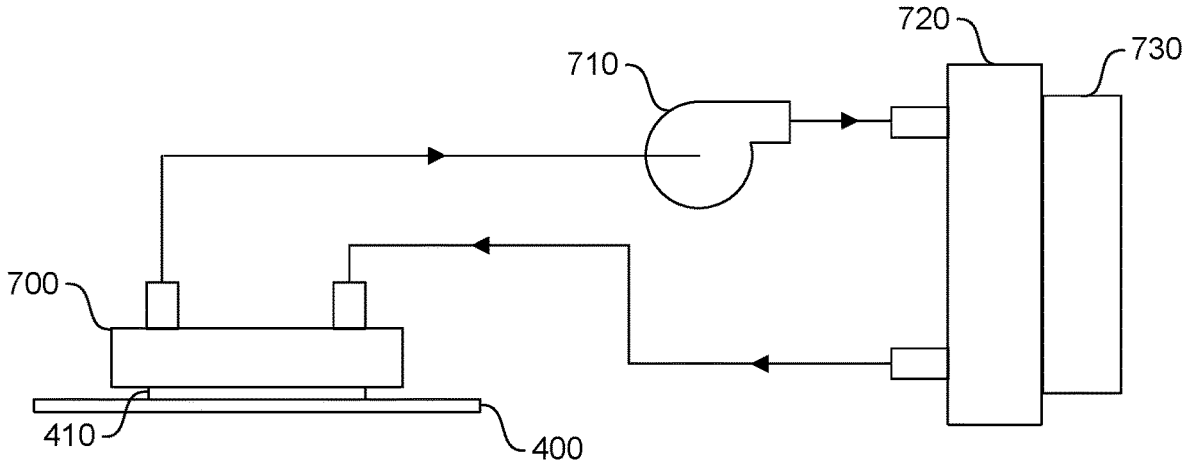
FIG. 7 shows a closed loop cooling system according to an exemplary embodiment.

FIG. 7 shows a closed loop cooling system according to an exemplary embodiment. According to the exemplary embodiment of FIG. 7, the cooling unit may include a closed loop cooling system instead of the blower fan 440, duct 430, and heat sink 420. The closed loop cooling system may include a cooling block 700 that is configured to hold a media such as water or other known liquids and or gasses used in-closed loop cooling systems. The cooling block 700 is in contact with the thermoelectric cooling modules 410 so that the heat from the hot plates of the thermoelectric cooling modules 410 is absorbed by the media. The closed loop cooling system may also include a pump 710 that pumps the media from the cooling block 700 to a radiator 720. The radiator 720 may have a series of fins (not shown) through which the media flows so that the heat from the media is absorbed by the fins. A fan 730 may be used to blow air across the radiator 720 to dissipate the heat absorbed by the fins of the radiator 720. The media then flows from the radiator 720 back to the cooling block 700 to again absorb more heat from the hot plates of the thermoelectric cooling modules 410.

Many different embodiments have been disclosed herein, in connection with the above description and the drawings. It will be understood that it would be unduly repetitious to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the embodiments described herein are not limited to what has been particularly shown and described herein above. In addition, unless mention was made above to the contrary, it should be noted that all of the accompanying drawings are not to scale. A variety of modifications and variations are possible in light of the above teachings.

What is claimed is:

1. A temperature-controlled cradle comprising:

a base comprising an outer housing and a cooling unit disposed within the outer housing; and a bassinet coupled to the base;

wherein the cooling unit comprises a cooling plate having a first side configured to chill an interior portion of the bassinet; at least one thermoelectric cooling module coupled in contact with a second side of the cooling plate; and a heat dissipation device configured to dissipate heat from the at least one thermoelectric cooling module; and wherein a bottom portion of the bassinet is open, and the cooling plate is co-planar with the bottom portion of the bassinet.

2. The temperature-controlled cradle of claim 1, wherein the heat dissipation device comprises a heat sink; and wherein the at least one thermoelectric cooling module is disposed between the second side of the cooling plate and the heat sink.

3. The temperature-controlled cradle of claim 2, wherein the cooling unit further comprises:

a blower fan configured to blow air toward the heat sink.

4. The temperature-controlled cradle of claim 3, wherein the cooling unit further comprises a duct coupled to the blower fan and the heat sink, and configured to direct the air blown by the blower fan toward the heat sink.

5. The temperature-controlled cradle of claim 4, wherein the duct comprises at least one open end portion that is configured to allow air to escape from the duct.

6. The temperature-controlled cradle of claim 4, wherein the duct comprises two lateral sides; and wherein at least one of the two lateral sides includes at least one flap that is configured to open to allow air to escape from the duct.

7. The temperature-controlled cradle of claim 4, further comprising a divider plate slidably disposed between the duct and the blower fan to control air flow from the blower fan to the duct.

8. The temperature-controlled cradle of claim 1, further comprising a foam layer coupled to the second side of the cooling plate.

9. The temperature-controlled cradle of claim 8, wherein the foam layer includes at least one cutout portion through which the at least one thermoelectric cooling module is disposed in contact with the second side of the cooling plate.

10. The temperature-controlled cradle of claim 1, wherein the heat dissipation device comprises:

a cooling block configured to contain a cooling media, said cooling block disposed in contact with said at least one thermoelectric cooling module;

a radiator configured to receive the cooling media from the cooling block;

a pump configured to pump the cooling media from the cooling block to the radiator; and a fan configured to blow air toward the radiator.

11. The temperature-controlled cradle of claim 10, wherein the at least one thermoelectric cooling module is disposed between the second side of the cooling plate and the cooling block.

12. A method of cooling a temperature-controlled cradle, the method comprising:

applying a DC voltage to at least one thermoelectric cooling module having a first side coupled in contact with a cooling plate disposed within a bassinet of the temperature- controlled cradle;

transferring heat from the first side of the at least one thermoelectric cooling module to a second side of the at least one thermoelectric cooling module; and dissipating heat from the second side of the at least one thermoelectric cooling module;

wherein a bottom portion of the bassinet is open, and the cooling plate is co- planar with the bottom portion of the bassinet.

13. The method of claim 12, wherein dissipating heat from the second side of the at least one thermoelectric cooling module comprises using a heat sink disposed against the second side of the at least one thermoelectric cooling module to dissipate heat therefrom.

14. The method of claim 13, wherein dissipating heat from the second side of the at least one thermoelectric cooling module further comprises blowing air toward the heat sink.

15. The method of claim 14, wherein blowing air toward the heat sink comprises blowing air through a duct configured to direct the air toward the heat sink.

16. The method of claim 15, wherein the duct comprises at least one open end portion configured to allow the air to escape from the duct.

17. The method of claim 15, wherein the duct comprises two lateral sides; and wherein the wherein at least one of the two lateral sides includes at least one flap that is configured to open to allow air to escape from the duct.

18. The method of claim 12, further comprising insulating a side of the cooling plate to which the at least one thermoelectric cooling module is coupled using a foam layer.

19. The method of claim 12, wherein dissipating heat from the second side of the at least one thermoelectric cooling module comprises:

using a cooling block configured to contain a cooling liquid for absorbing heat from the second side of the at least one thermoelectric cooling module;

pumping the cooling liquid from the cooling block to a radiator configured to absorb heat from the cooling liquid; and blowing air toward the radiator to dissipate heat from the radiator.

* * * * *